US009637343B2

(12) United States Patent
Allwood

(10) Patent No.: US 9,637,343 B2
(45) Date of Patent: May 2, 2017

(54) ASSEMBLY FOR DISPENSING CABLE

(75) Inventor: Brent David Allwood, Buttaba (AU)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 645 days.

(21) Appl. No.: 13/327,094

(22) Filed: Dec. 15, 2011

(65) Prior Publication Data

US 2012/0153069 A1 Jun. 21, 2012

(30) Foreign Application Priority Data

Dec. 15, 2010 (AU) ..... 2010257221

(51) Int. Cl.
*B65H 75/14* (2006.01)
*B65H 49/32* (2006.01)
*B65H 75/30* (2006.01)

(52) U.S. Cl.
CPC ..... *B65H 49/328* (2013.01); *B65H 49/32* (2013.01); *B65H 75/14* (2013.01); *B65H 75/30* (2013.01); *Y10T 29/49826* (2015.01)

(58) Field of Classification Search
CPC .... B65H 49/32; B65H 49/322; B65H 49/328; B65H 75/14; B65H 75/30; Y10T 29/29826
USPC ..... 242/608, 608.2, 608.6, 609, 609.1, 605, 242/598.5
See application file for complete search history.

(56) References Cited

U.S. PATENT DOCUMENTS

| | | | | |
|---|---|---|---|---|
| D15,146 | S | 7/1884 | Helmus et al. | |
| 2,501,201 | A | 3/1950 | Wilcox | |
| D200,791 | S | 4/1965 | Smith | |
| 3,207,456 | A | 9/1965 | Hill | |
| 3,565,363 | A * | 2/1971 | Toru Mizuguchi et al. | 242/608.4 |
| 3,876,045 | A * | 4/1975 | Knarreborg | 191/12.2 R |
| 3,958,775 | A * | 5/1976 | Liga | 242/118.8 |
| 4,014,477 | A | 3/1977 | Hyun | |
| 4,141,479 | A | 2/1979 | Dennison | |
| 4,591,109 | A * | 5/1986 | Kremer | 242/129 |
| D285,901 | S | 9/1986 | Gustavsson | |
| 4,685,633 | A * | 8/1987 | Pellini | 242/598.3 |
| 4,821,880 | A | 4/1989 | Ditton | |
| 4,842,211 | A | 6/1989 | Robbins | |

(Continued)

FOREIGN PATENT DOCUMENTS

| | | |
|---|---|---|
| DE | 195 10 427 | 9/1996 |
| JP | 61-41165 | 3/1986 |

(Continued)

OTHER PUBLICATIONS

Design U.S. Appl. No. 29/393,774, filed Jun. 9, 2011, titled Assembly for Dispensing Cable, first named inventor Brent David Allwood.

(Continued)

*Primary Examiner* — Emmanuel M Marcelo
*Assistant Examiner* — Justin Stefanon
(74) *Attorney, Agent, or Firm* — Merchant & Gould P.C.

(57) ABSTRACT

An assembly for dispensing cable from a spool, including first and second end members separated by one or more cross-members; and an axle extending at least partially between the end members for rotatably coupling the spool to the assembly, wherein end sections of the cross-members are releasably coupled to respective keyed slots of the end members.

20 Claims, 9 Drawing Sheets

(56) References Cited

U.S. PATENT DOCUMENTS

| | | | | | |
|---|---|---|---|---|---|
| 4,903,913 | A * | 2/1990 | McCaffrey | B65H 75/22 | 242/118.6 |
| 5,046,677 | A | 9/1991 | Loewe et al. | | |
| 5,184,743 | A | 2/1993 | Suzuki et al. | | |
| 5,238,105 | A * | 8/1993 | Smiley | B65D 71/00 | 206/223 |
| 5,261,625 | A * | 11/1993 | Lanoue | B65H 49/322 | 242/129.62 |
| D367,575 | S | 3/1996 | Thompson | | |
| 5,551,647 | A * | 9/1996 | Browning | B65H 49/305 | 242/118.5 |
| 5,598,985 | A * | 2/1997 | Winesett | 242/395 | |
| 5,897,075 | A | 4/1999 | Elder et al. | | |
| 5,941,396 | A * | 8/1999 | Le Vert | B65H 49/32 | 211/13.1 |
| 5,954,294 | A | 9/1999 | Forsner | | |
| 5,967,451 | A | 10/1999 | Radaios | | |
| 6,016,911 | A | 1/2000 | Chen | | |
| 6,234,421 | B1 | 5/2001 | Cox et al. | | |
| 6,315,122 | B1 * | 11/2001 | McCord et al. | 206/408 | |
| 6,398,154 | B1 * | 6/2002 | Cox et al. | 242/608.2 | |
| 6,523,777 | B2 * | 2/2003 | Gaudio | 242/595.1 | |
| 6,672,529 | B2 * | 1/2004 | Cain | B65H 75/14 | 242/394 |
| 6,705,564 | B2 * | 3/2004 | Bootsman et al. | 242/588.3 | |
| 6,715,710 | B1 * | 4/2004 | Russell | B65H 75/18 | 242/605 |
| 6,834,827 | B2 | 12/2004 | Burkitt | | |
| 6,877,687 | B2 * | 4/2005 | Moon et al. | 242/390.8 | |
| 6,913,145 | B2 | 7/2005 | Barton et al. | | |
| 7,309,038 | B2 | 12/2007 | Carroscia | | |
| 7,311,285 | B2 | 12/2007 | Rauch et al. | | |
| 7,481,394 | B2 * | 1/2009 | Gleason | 242/594.2 | |
| D586,203 | S | 2/2009 | Zhang | | |
| D600,098 | S | 9/2009 | Allwood | | |
| 8,074,916 | B2 * | 12/2011 | Penumatcha | B65H 75/14 | 242/604 |
| 8,584,851 | B2 * | 11/2013 | Brendel | 206/408 | |
| 2006/0196794 | A1 | 9/2006 | Nicklas | | |
| 2006/0273217 | A1 | 12/2006 | Wilkinson | | |
| 2009/0314876 | A1 * | 12/2009 | Kessler et al. | 242/608.6 | |
| 2011/0101148 | A1 | 5/2011 | Allwood | | |
| 2013/0087652 | A1 * | 4/2013 | Chastain | B65H 49/322 | 242/588.3 |

FOREIGN PATENT DOCUMENTS

| | | |
|---|---|---|
| JP | 6-144714 | 5/1994 |
| JP | 10-279194 | 10/1998 |
| WO | WO 2009/143919 | 12/2009 |

OTHER PUBLICATIONS

International Search Report for PCT/EP2009/001487 mailed Jun. 23, 2009. (Form PCT/ISA/210.).

* cited by examiner

ASSEMBLY FOR DISPENSING CABLE

This application claims benefit of Serial No. 2010257221, filed 15 Dec. 2010 in Australia and which application is incorporated herein by reference. To the extent appropriate, a claim of priority is made to the above disclosed application.

TECHNICAL FIELD OF THE INVENTION

The present invention relates to an assembly for dispensing cable.

BACKGROUND OF THE INVENTION

A number of systems have been developed to package and dispense wound flexible media (hereafter referred to as cable). For example, spools of cable have previously been packaged in cardboard boxes with internal plastic supports for rotatably mounting the spools. Cardboard cartons permit cable to be removed from the front of the box, for example. However, the cardboard packaging does not typically permit the spool to be viewed as cable is being dispensed and, consequently, the operator may not be able to see how the cable is feeding off the spool. In addition, the packaging may not lend itself to easy handling and maneuvering in environments with limited space, for example.

A further difficulty with the cardboard packaging is that it may not be sufficiently strong to support the weight of the same product stacked on top of it. This may be a problem when it is desirable to draw cable from multiple packages. For example, in an installation where bundles of up to 12 cables are being installed, the cartons are typically stacked in a 3×4 configuration. In this configuration, the cardboard packages can be quite unstable when the cable is pulled off the spools at the same time. Extra means are usually needed to make the stack of packages stable during such an operation. Further, the cardboard packaging may not be sufficiently strong to permit palletisation.

Other dispensing systems have been developed with a view to overcoming the above described difficulties. For example, U.S. Pat. No. 6,523,777 teaches, with reference to FIG. 1, a portable wire spool caddy that includes a frame (12) with end plates (14, 16) separated by rectangular supporting members (18, 20). The caddy is shaped to house a reel (42) between the support members (18, 20) and the plates (14, 16) in a manner that permits the reel (42) to spin as cable is drawn therefrom. The caddy also includes a swing (80) and bracket (54) which is adapted to bear against the reel (42) and function as a braking mechanism. The wire spool caddy taught by U.S. Pat. No. 6,523,777 may provide a useful device for generally dispensing cable. However, the wire spool caddy may not facilitate easy assembly and disassembly for transportation and storage. Further, U.S. Pat. No. 6,523,777 may not provide a mechanism that can tie-off an end of the cable and stop the reel (42) from rotating due to inertia during transportation.

Similarly, U.S. Pat. No. 5,967,451 teaches a carrier for carrying one or more wire spools. With reference to FIG. 1 of U.S. Pat. No. 5,967,451, the carrier includes end plates (26, 28) connected by a central rod (20), connecting rods (48, 50) and handle (46). The carrier includes a semicircular cradle (24) arranged to support the wire spools (12, 14) and to protect them from "free wheeling" in which the spools continue to spin after the user has ceased pulling the wire from the spools. The cradle (24) includes a number of slots (36), one for each spool, through which wire is drawn from the spools (12, 14). The cradle taught by U.S. Pat. No. 5,967,451 may provide a useful device for generally dispensing cable. However, the cradle may not facilitate easy assembly and disassembly for transportation and storage. Further, U.S. Pat. No. 5,967,451 may not provide a mechanism that can stop the wire spool (12, 14) from rotating due to inertia during transportation, for example.

It is generally desirable to overcome or ameliorate one or more of the above mentioned difficulties, or at least provide a useful alternative.

SUMMARY OF THE INVENTION

In accordance with one aspect of the invention, there is provided a spool for receiving a length of cable, including:

(a) a drum comprising first and second parts; and (b) two flanges couplable to respective opposed end sections of said drum, wherein said end sections of the drum mate with locking sections of the flanges when the parts of the drum are coupled together.

Preferably, opposite end sections of the drum are open and include inner peripheral ledges shaped to fit over corresponding outer peripheral ledges of the locking sections of the flanges.

Preferably, the outer peripheral ledges of the locking sections are castellated with projections.

Preferably, the locking sections include locking keys that extend into corresponding slots of the open end sections of the drum to inhibit rotation of the drum with respect to the flanges.

Preferably, outer peripheral edge sections of the flanges are fluted.

In accordance with another aspect of the invention, there is provided a method of assembling the above-described spool, including the steps of:

(a) mating a locking section of a first one of said flanges with an end section of a first one of said parts;

(b) mating a locking section of a second one of said flanges with another end section said first one of said parts; and (c) coupling a second one of said parts to the first one of said parts.

In accordance with another aspect of the invention, there is provided an assembly for dispensing cable from a spool, including:

(a) first and second end members separated by one or more cross-members; and (b) an axle extending at least partially between the end members for rotatably coupling the spool to the assembly, wherein end sections of the cross-members are releasably coupled to respective keyed slots of the end members.

Preferably, the keyed slots each include:

(i) a receiving section for receiving an end section of one of said cross-members;

(ii) a locking section being shaped to receive said end section from the receiving section and inhibit movement of the cross-member in a lengthwise axial direction of the cross-member; and (iii) a key extending over the receiving section for inhibiting movement of the cross-member from the locking section towards the receiving section.

Preferably, end sections of the cross-members include pairs of locking flanges extending radially with respect to a lengthwise axis of the cross-members.

Preferably, the receiving sections are shaped to receive end sections of the cross-members so as to locate locking flanges of on either side of locking surfaces in the locking sections.

Preferably, the end sections of the cross-members resiliently deflect keys of the keyed slots when seated in the receiving sections.

In accordance with another aspect of the invention, there is provided a method of assembling the above-described assembly, including the steps of:

(a) mounting the spool on the axle;

(b) seating the cross-members to corresponding pairs of keyed slots of the first and second members; and (c) locking the cross-members in the pairs of keyed slots.

In accordance with another aspect of the invention, there is provided, in combination, the above described assembly and the above described spool coupled thereto.

BRIEF DESCRIPTION OF THE DRAWINGS

Preferred embodiments of the present invention are hereafter described, by way of non-limiting example only, with reference to the accompanying drawing in which.

DETAILED DESCRIPTION OF PREFERRED EMBODIMENTS OF THE INVENTION

Figure 1:
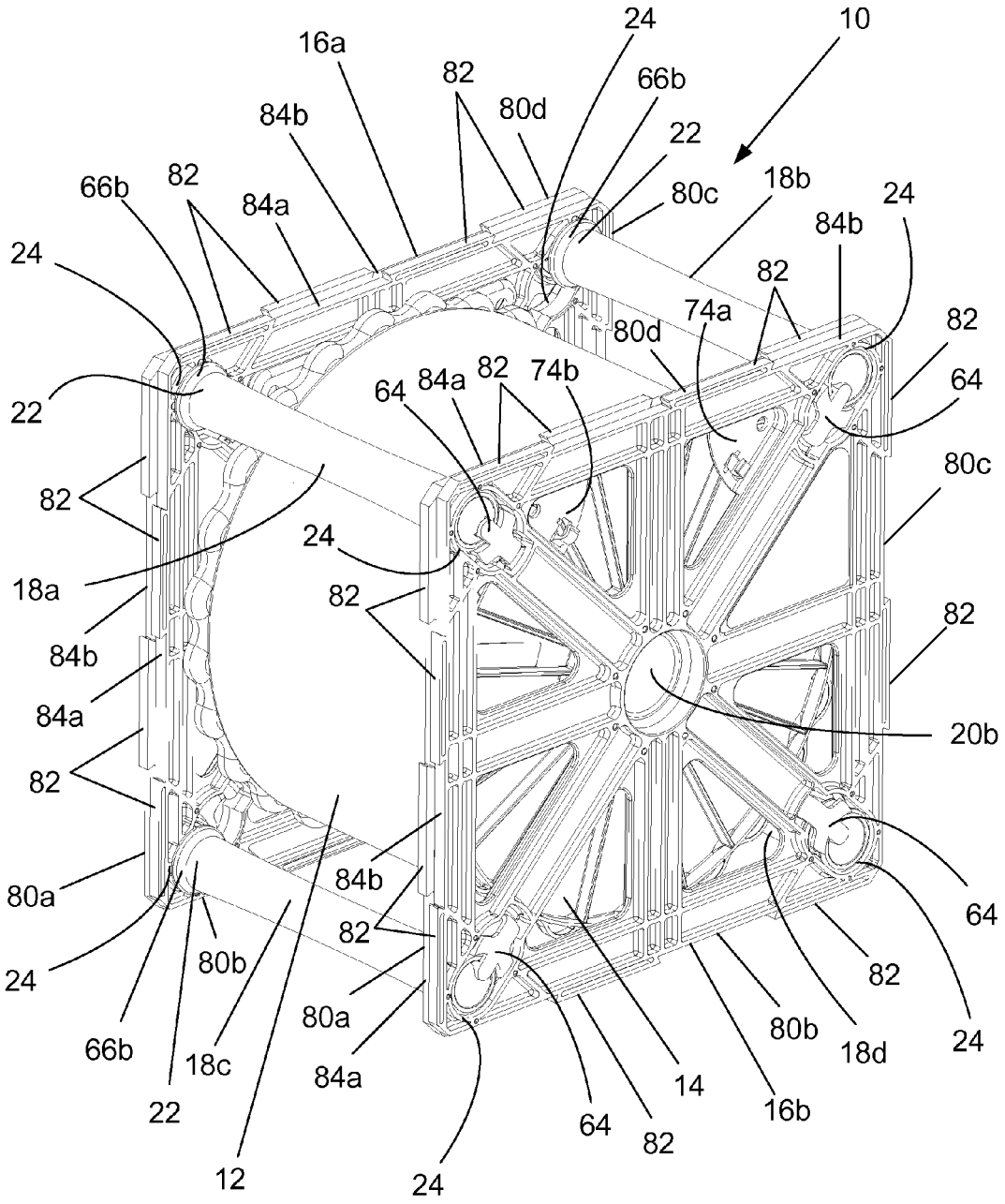
FIG. 1 is a front perspective view of an assembly for dispensing cable.
Figure 2:
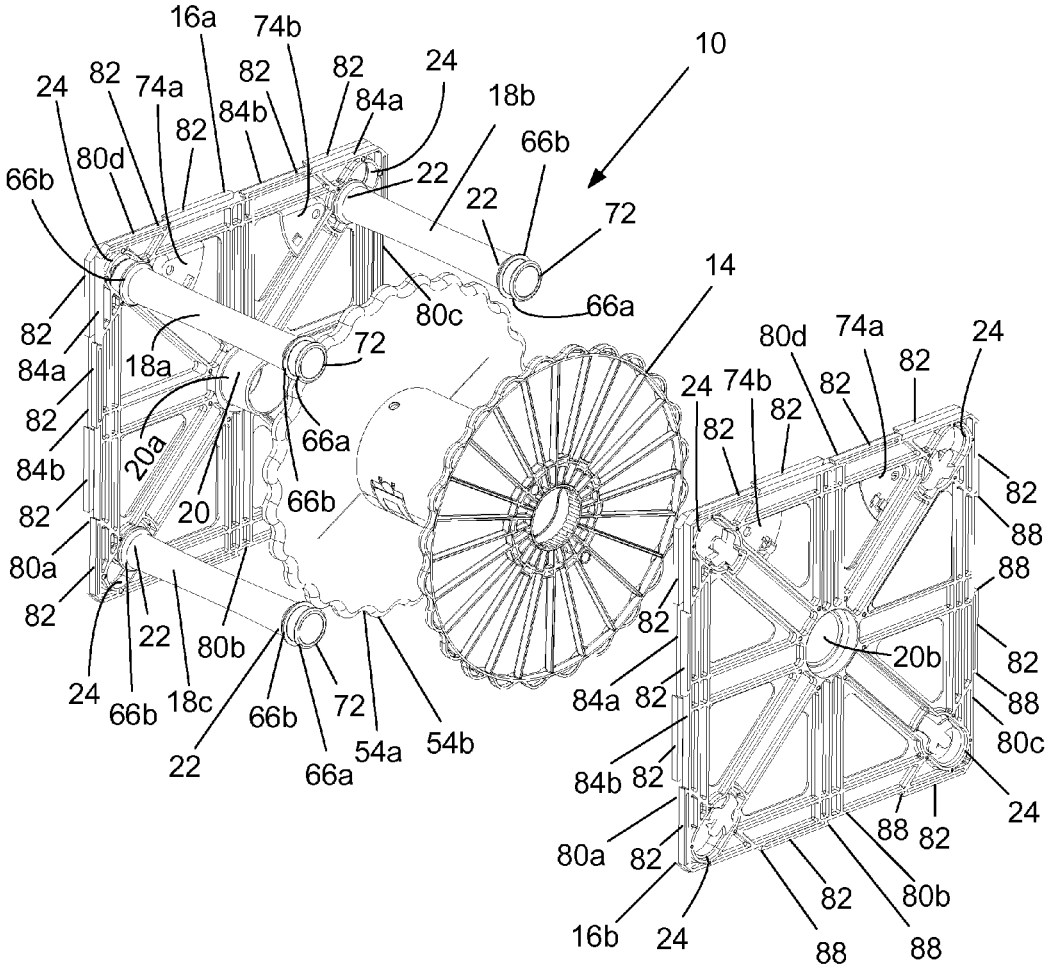
FIG. 2 is a partially exploded view of the assembly shown in FIG. 1.
Figure 3:
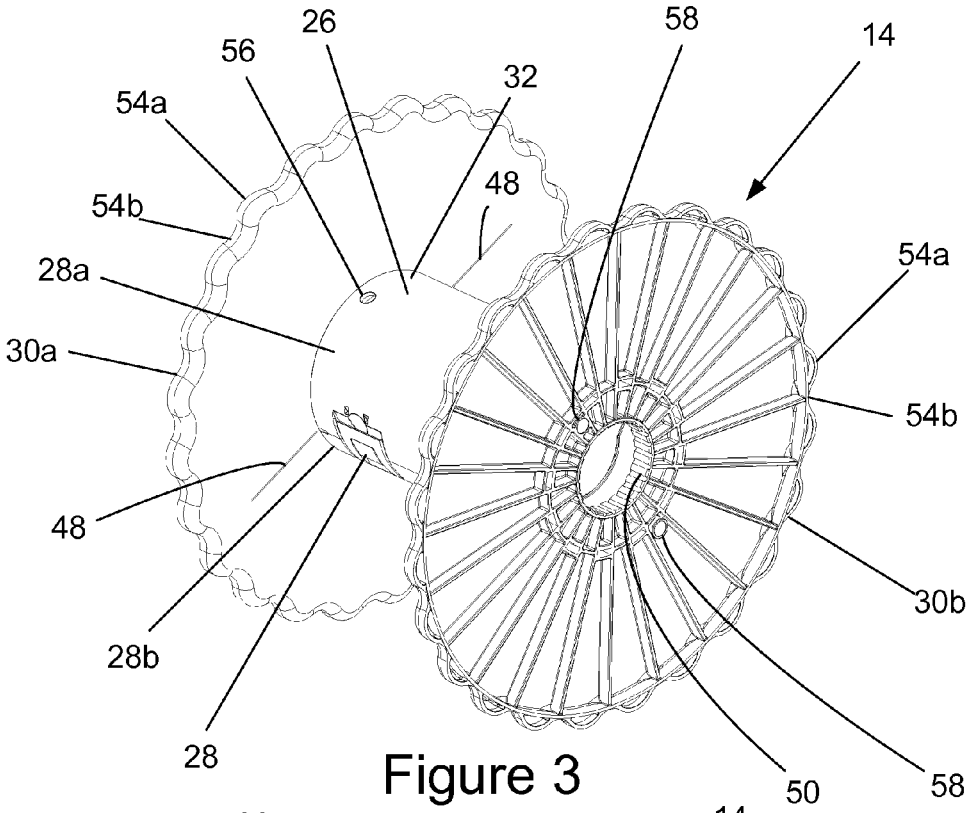
FIG. 3 is a front perspective view of a spool of the assembly shown in FIG. 1.

The assembly 10 shown in FIGS. 1 and 2 is used to dispense cable 12, for example, from a spool 14. The assembly 10 includes first and second end members 16*a*, 16*b* separated by four cross-members 18*a*, 18*b*, 18*c*, 18*d*. Alternatively, the assembly 10 can have one or more cross-members 18*a*, 18*b*, 18*c*, 18*d*. The assembly 10 also includes an axle 20 extending at least partially between the end members 16*a*, 16*b* for rotatably coupling the spool 14 thereto. Preferably, the axle 20 is formed in two axially aligned parts 20*a*, 20*b* that extend towards each other from respective opposed sides of the end members 16*a*, 16*b*. End sections 22 of the cross-members 18*a*, 18*b*, 18*c*, 18*d* are releasably coupled to respective keyed slots 24 of the end members 16*a*, 16*b*.

As particularly shown in FIGS. 3 to 7, the spool 14 includes a drum 26 comprising first and second parts 28*a*, 28*b*; and two flanges 30*a*,30*b* couplable to respective opposed end sections 32 of the drum 26. The drum 26 is preferably a cylindrical tube formed when the two concave parts 28*a*, 28*b* are coupled together in the manner shown in FIG. 5. The parts 28*a*, 28*b* are coupled together by a fastener 34. The fastener 34 preferably includes four pairs of male and female interlocking clips 34*a*, 34*b* that snap closed as the parts 28*a*, 28*b* are fitted together. The male and female interlocking clips 34*a*, 34*b* are releasably couplable together so that the spool 14 can be disassembled.

Figure 5:
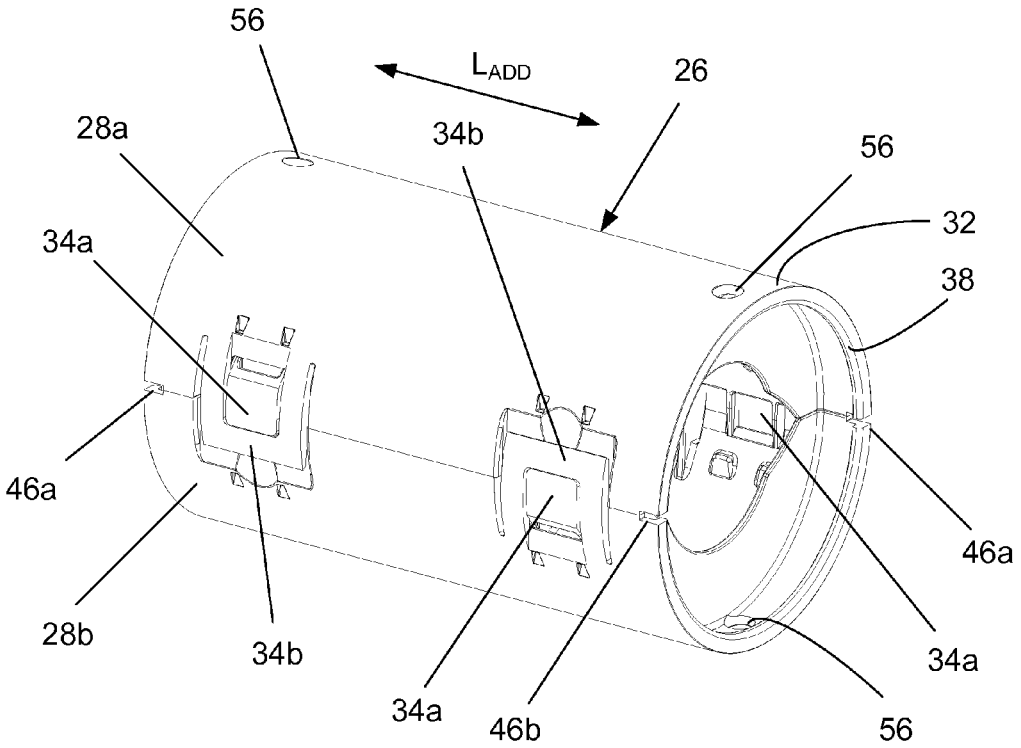
FIG. 5 is a front perspective view of a drum of the spool shown in FIG. 3.
Figures 6, 7:
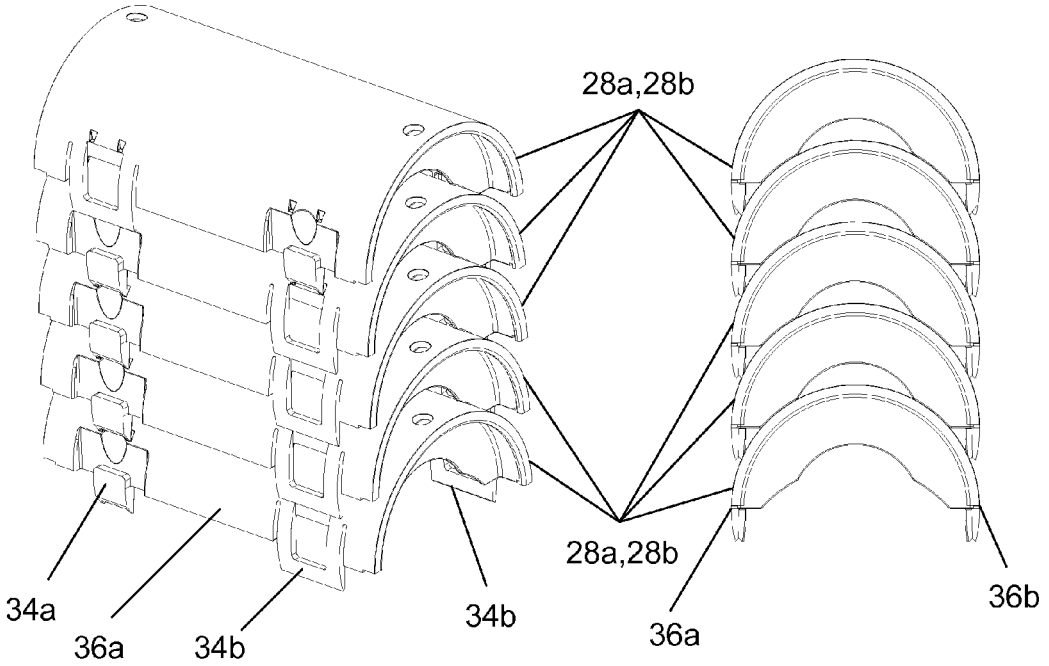
FIG. 6 is a front perspective view of a plurality of parts of the drum shown in FIG. 5 stacked on top of one another.
FIG. 7 is a side view of the stack of parts shown in FIG. 6.
Figure 8A:
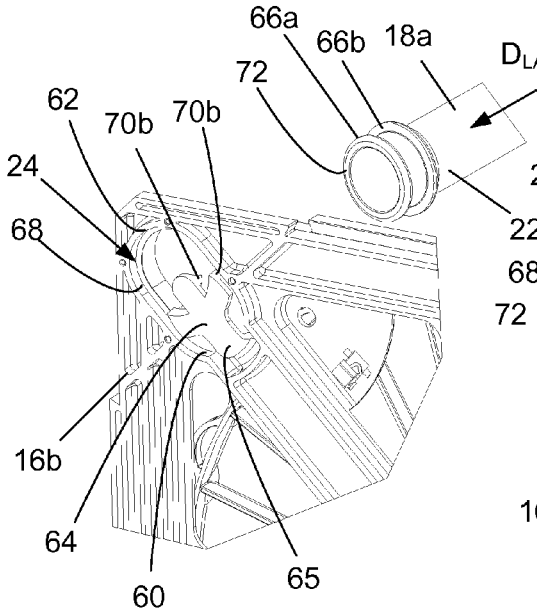
FIGS. 8*a* to 8*d* are enlarged views of a section of the assembly shown in FIG. 1 arranged in different conditions of use.
Figure 8B:
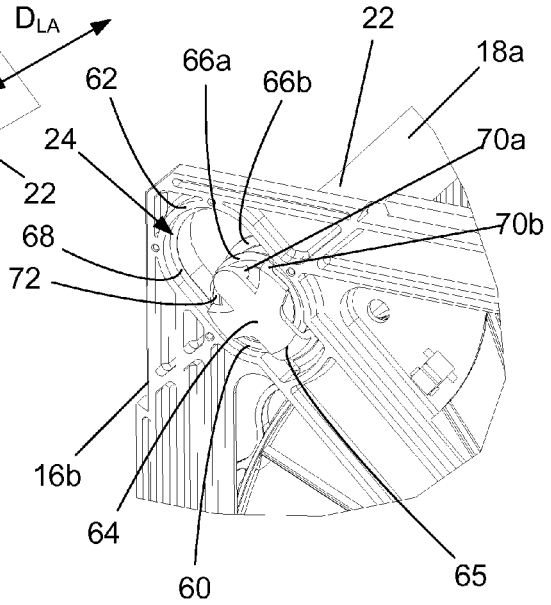
Figure 8C:
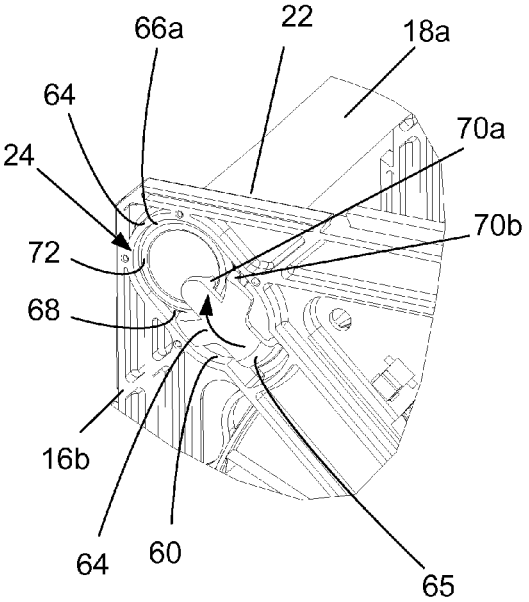
Figure 8D:
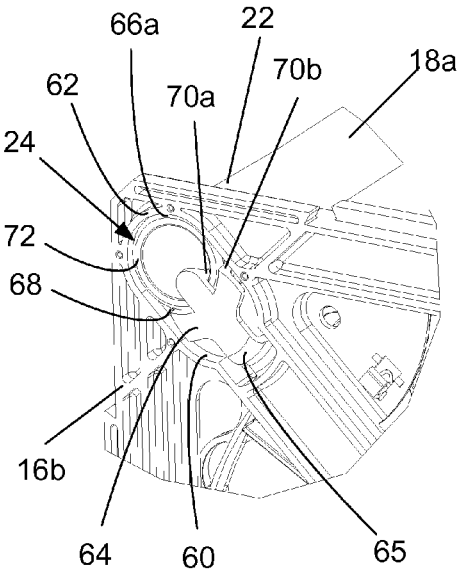

As particularly shown in FIGS. 6 and 7, the parts 28*a*, 28*b* of the spool 14 preferably have the same shape and configuration. To this end, opposed elongate sides 36*a*, 36*b* of each part 28*a*, 28*b* of the drum 26 each include projecting portions of a male clip 34*a* and a female clip 34*b*. In this arrangement, corresponding male and female clips 34*a*, 34*b* interlock when the parts 28*a*, 28*b* of the drum 26 are fitted together in the manner shown in FIG. 5.

The first and second parts 28*a*, 28*b* of the drum 26 are semi circular in a lengthwise axial $L_{ADD}$ cross-section so that the drum 26 is circular in a lengthwise axial $L_{ADD}$ cross-section when the parts 28*a*, 28*b* are coupled together.

Figure 4:
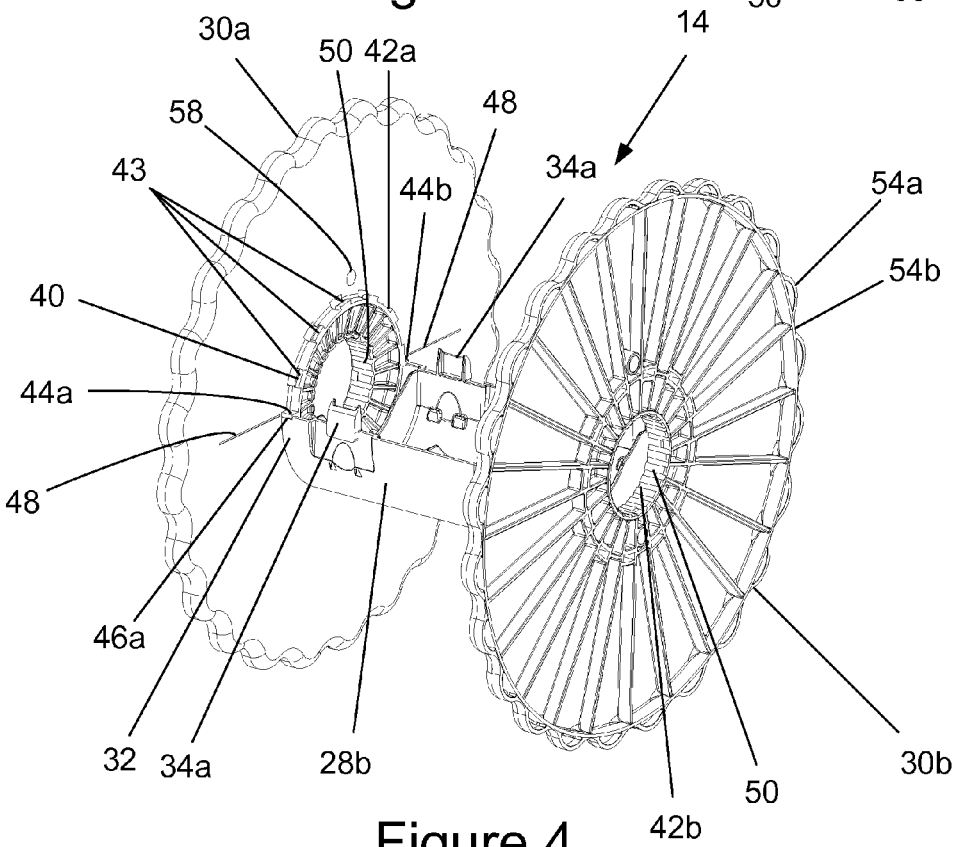
FIG. 4 is a front perspective view of the spool shown in FIG. 3 with a part of the drum removed.

As particularly shown in FIGS. 4 and 5, opposite end sections 32 of the cylindrical drum 26 are open and include inner peripheral ledges 38 shaped to fit over corresponding outer peripheral ledges 40 of circular locking sections 42*a*, 42*b* of the flanges 30*a*, 30*b*. The outer peripheral ledges 40 of circular locking sections 42*a*, 42*b* preferably castellated with projections 43.

The circular locking sections 42*a*, 42*b* each include a pair of locking keys 44*a*, 44*b* that are positioned to fit into slots 46*a*, 46*b* formed between the parts 28*a*, 28*b* of the end sections 32 of the drum 26. The flanges 30*a*, 30*b* include indicia 48 marking the position of the keys 44*a*, 44*b*.

The spool 14 is assembled by performing the following steps:

a. the second part 28*b* of the drum 26 is coupled to the locking sections 42*a*, 42*b* of opposed flanges 30*a*, 30*b* so that:
   i. the ledges 38 of the end sections 32 of the second part 28*b* are fitted over the ledges 40 of the locking sections 42*a*, 42*b*; and
   ii. the pairs of keys 44*a*, 44*b* are seated in the slots 46*a*, 46*b* of the second part 28*b;*
b. the first part 28*a* of the drum 26 is coupled to the locking sections 42*a*, 42*b* of opposed flanges 30*a*, 30*b* so that:
   i. the ledges 38 of the end sections 32 of the first part 28*a* are fitted over the ledges 40 of the locking sections 42*a*, 42*b*; and
   ii. the pairs of keys 44*a*, 44*b* are seated in the slots 46*a*, 46*b* of the first part 28*a*; and
c. interconnecting the male and female clips 34*a*, 34*b* of the first and second parts 28*a*, 28*b* together so that the drum 26 locks around the locking sections 42*a*, 42*b* of the flanges 30*a*, 30*b*.

The locking sections 42*a*, 42*b* are keyed to inhibit rotation of the drum 26 with respect to the flanges 30*a*, 30*b*.

The locking sections 42*a*, 42*b* of the flanges 30*a*, 30*b* include profiled bearing surfaces 50 shaped to fit over respective sections 20*a*, 20*b* of the axle 20. These profiled bearing surfaces 50 reduce friction, and resulting heat, between the surfaces 20, 50 as they articulate over each other. The profiled bearing surfaces 50 also allow any dust, or plastic material that is abraded from the bearing surfaces 50, to be immediately isolated away from the articulating surfaces 20, 50.

Outer peripheral edge sections 52 of the flanges 30*a*, 30*b* are fluted with peaks 54*a* and troughs 54*b*. One or both of the flanges 30*a*, 30*b* include an outer slot 58 shaped for engagement with a drive dog (not shown) for spooling cable onto the spool 14 before installation on the assembly 10.

As particularly shown in FIGS. 8*a* to 8*d*, the keyed slots 24 of the first and second end members 16*a*, 16*b* each include:

(a) a receiving section 60 shaped to receive an end section 22 of the cross-member 18*a;*

(b) a locking section 62 being shaped to receive the end section 22 from the receiving section 60 and to inhibit movement of the cross-member 18*a* in a lengthwise axial direction $D_{LA}$ of the cross-member 18*a*; and (c) a key 64 extending over the receiving section 62 for inhibiting movement of the cross-member 18*a* from the locking section 62 towards the receiving section 60.

The keys 64 are preferably coupled to the receiving sections by arms 65. Alternatively, the key 64 extends over the locking section 62 and inhibits movement of the cross-member 18*a* from the locking section 62 towards the receiving section 60.

End sections 22 of the cross-members 18*a*, 18*b*, 18*c*, 18*d* include a pair of spaced apart locking flanges 66*a*, 66*b* extending radially with respect to a lengthwise axis $D_{LA}$ of the cross-members 18*a*, 18*b*, 18*c*, 18*d*. The receiving sections 62 are shaped to receive end sections 22 of the cross-members 18*a*, 18*b*, 18*c*, 18*d* so that a first locking flange 66*a* is seated in the receiving section 60 and a second locking flange 66*b* abuts the receiving section 60. As the cross-members 18*a*, 18*b*, 18*c*, 18*d* are pushed towards respective locking sections 62, the locking flanges 66*a*, 66*b* are located on either side of a locking surface 68 of the locking section 62. The locking sections 62 thereby inhibit movement of the cross-members 18*a*, 18*b*, 18*c*, 18*d* in a lengthwise axial direction $D_{LA}$.

Open end sections 72 of the cross-members 18*a*, 18*b*, 18*c*, 18*d* resiliently deflect keys 64 of the keyed slots 24 when seated in corresponding receiving sections 60. The end sections 72 of the cross-members 18*a*, 18*b*, 18*c*, 18*d* also resiliently deflect keys 64 of the keyed slots 24 when seated in corresponding locking sections 62.

Distal end sections of the keys include pairs of locking members 70*a*, 70*b*. The pairs of locking members 70*a*, 70*b* being shaped to receive the open end sections 72 of the cross-members 18*a*, 18*b*, 18*c*, 18*d* therebetween. The pairs of locking members 70*a*, 70*b* resiliently separate to accommodate open end 72 of the cross-members 18*a*, 18*b*, 18*c*, 18*d* therebetween. The pairs of locking members 70*a*, 70*b* of the keys 64 thereby inhibit movement of the cross-members 18*a*, 18*b*, 18*c*, 18*d* towards corresponding receiving sections 60 of the keyed slots 24.

Figure 9:
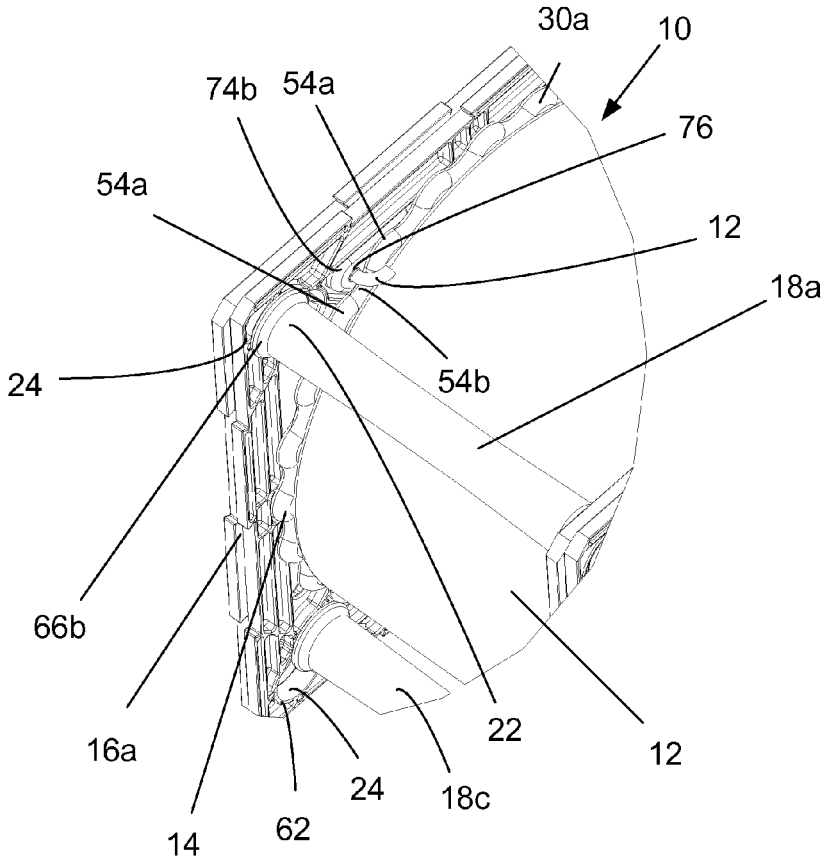
FIG. 9 is an enlarged view of another section of the assembly shown in FIG. 1 arranged in a condition of use.
Figure 10:
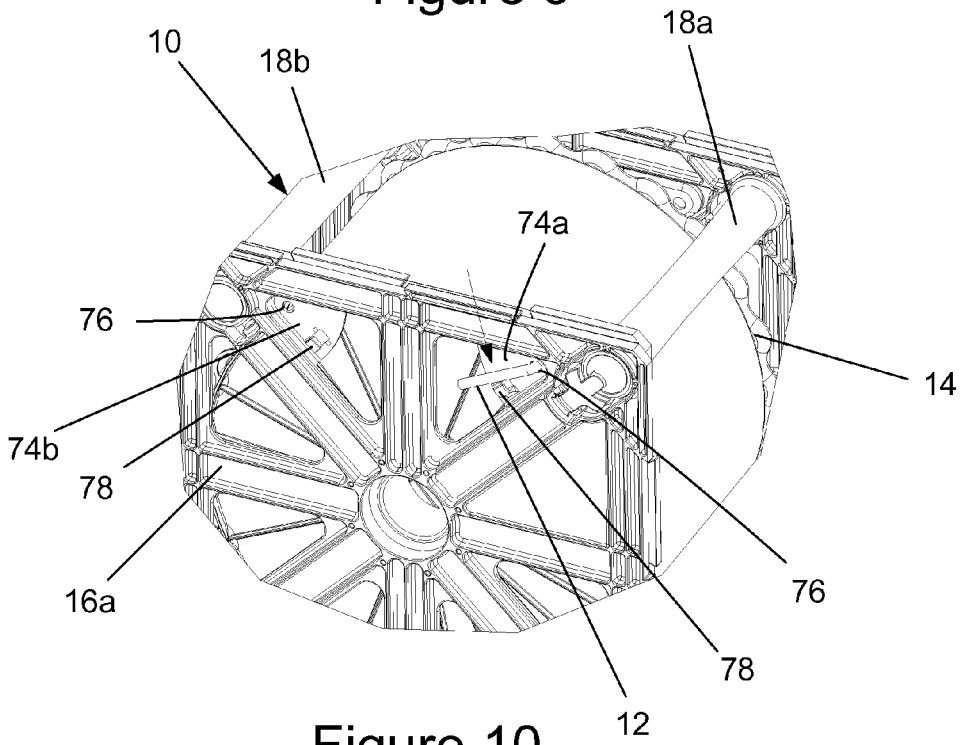
FIG. 10 is another enlarged view of the section of the assembly shown in FIG. 9.

The assembly 10 includes tie off sections 74*a*, 74*b* that are used to tie off end sections of cable 12 and inhibit rotation of the spool 26 when the spool 26 is not in use. As particularly shown in FIGS. 9 and 10, the first and second members 16*a*, 16*b* each include two tie off sections 74*a*, 74*b* which each include an aperture 76 and a retainer 78. The end section of the cable 12 is threaded through the aperture 76 and secured to the tie off section 74*a* with the retainer 78. In doing so, the cable extends over the flange 30*a* and settles in a tough 54*b* of the fluted rim of the spool 14. Rotation of the spool 14 around the axle 20 is thereby inhibited.

The first and second members 16*a*, 16*b* are generally planar surfaces defined by four sides 80*a*, 80*b*, 80*c*, 80*d*. The assembly 10 includes a common series of raised locking members 82 staggered alternatively between inner and outer sections 84*a*, 84*b* of each side 80*a*, 80*b*, 80*c*, 80*d* of the members 16*a*, 16*b*. The assembly 10 therefore also includes a common series of locking member receiving sections 86 staggered alternatively between outer and inner sections 84*b*, 84*a* of each side 80*a*, 80*b*, 80*c*, 80*d* of the members 16*a*, 16*b*.

Figure 11:
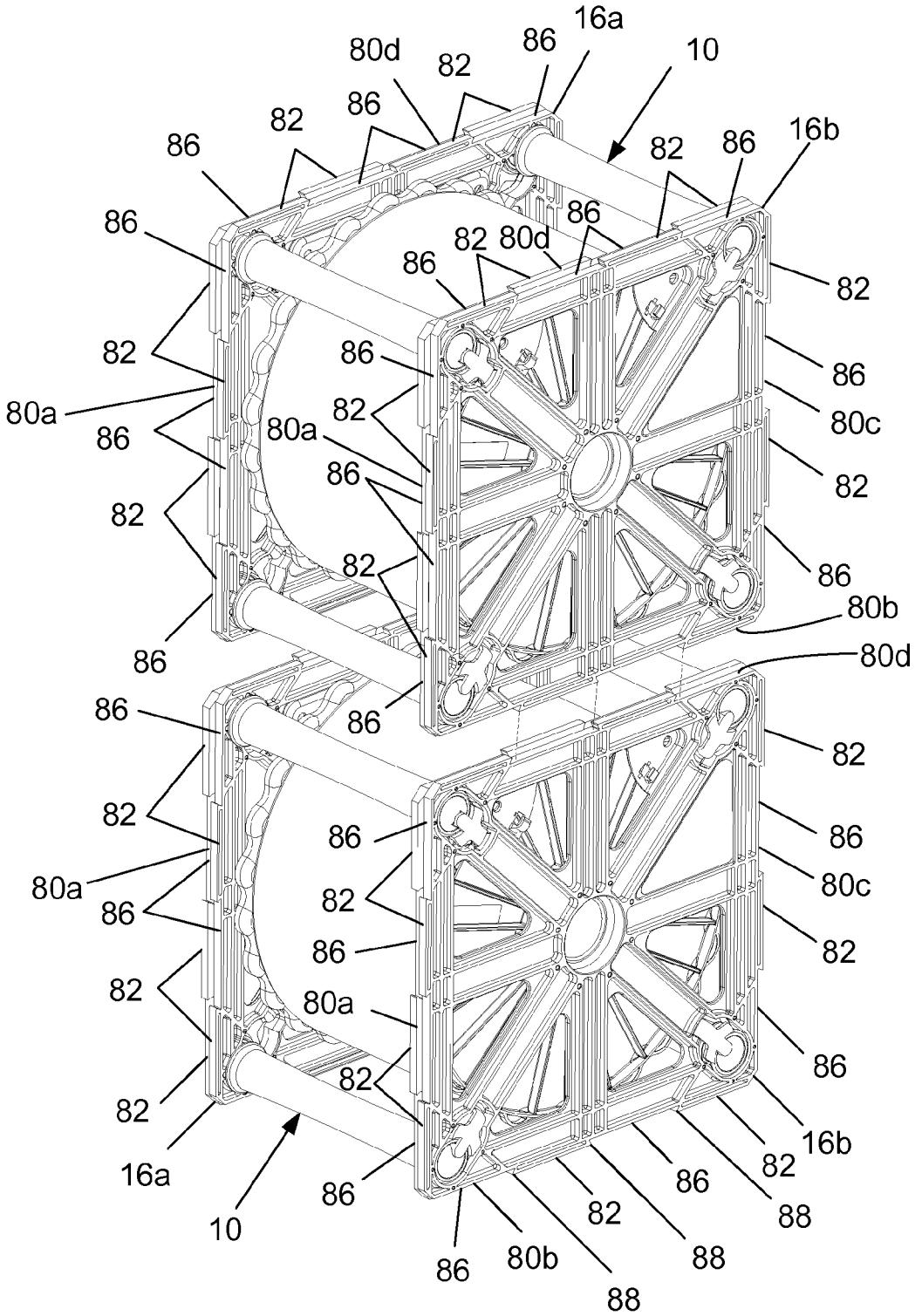
FIG. 11 is a front perspective view of the assembly shown in FIG. 1 being stacked on top of another assembly.
Figure 12:
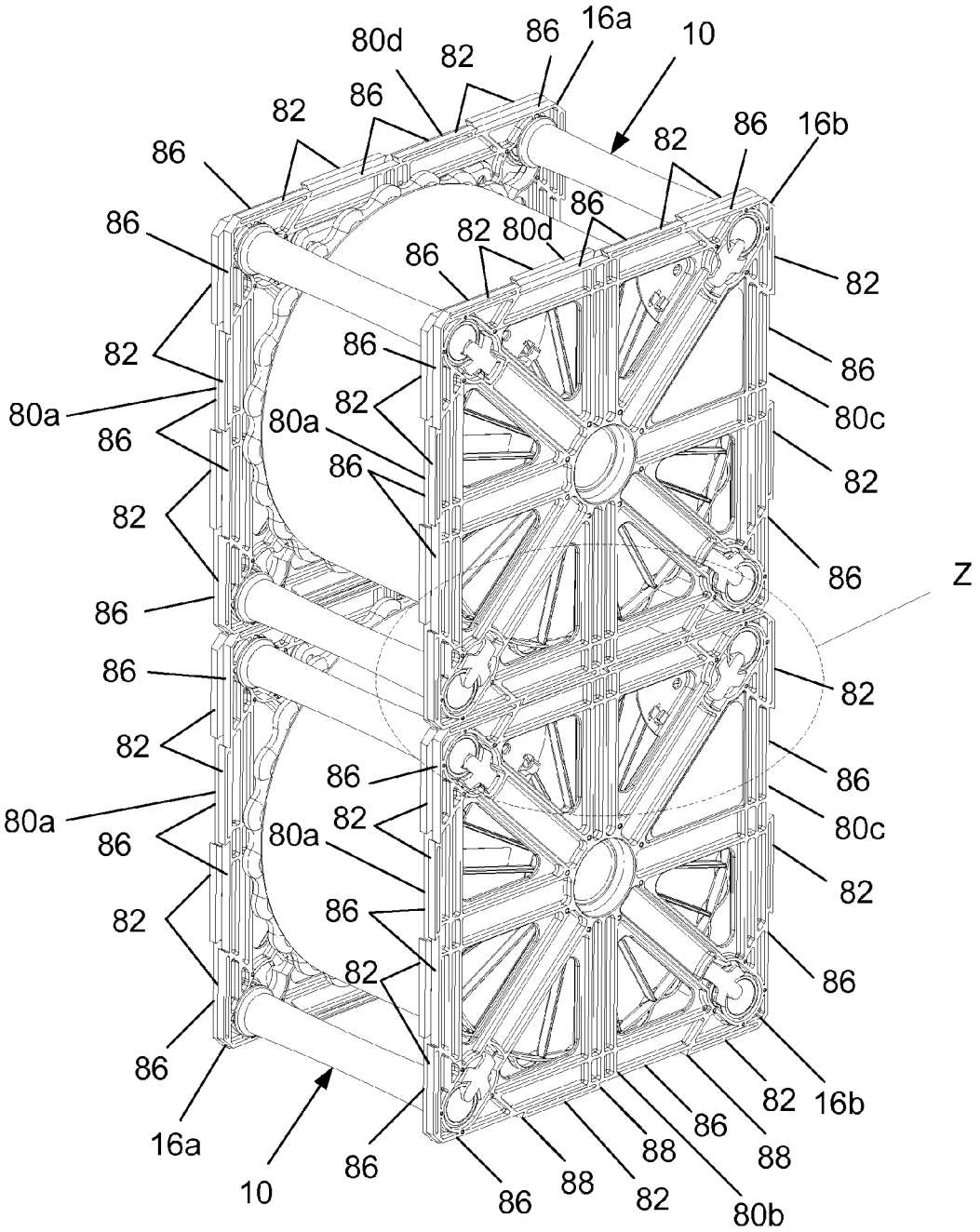
FIG. 12 is a front perspective view of the assembly shown in FIG. 1 stacked on top of another assembly.
Figure 13:
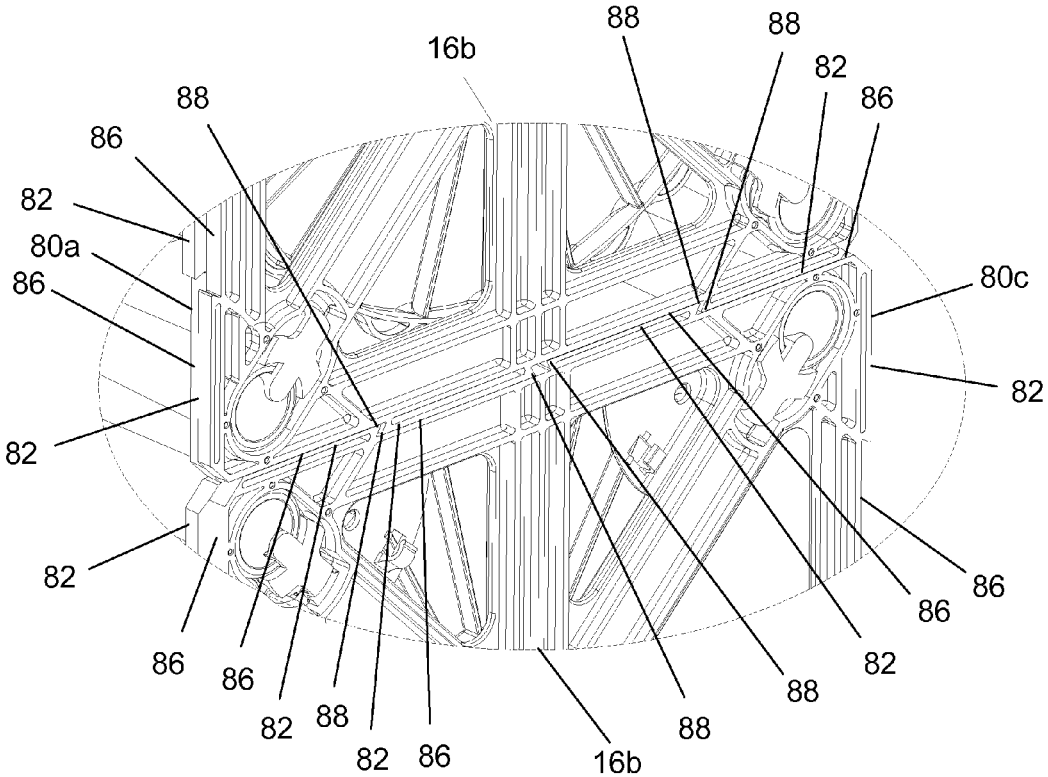
FIG. 13 is an enlarged view of section "Z" of the stacked assemblies shown in FIG. 12.

As particularly shown in FIGS. 11 to 13, the locking members 82 of a side 80*a*, 80*b*, 80*c*, 80*d* of the assembly 10 can be seated in the receiving section 86 of a side 80*a*, 80*b*, 80*c*, 80*d* of another assembly 10. The receiving sections 86 are preferably larger than the corresponding locking members 82 so that the locking members 82 can be easily seated therein when the assemblies are stacked. The locking members 82 include angled articular ends 88 for mating with corresponding angled articular ends 88 of locking members 82 of another corresponding assembly 10.

The locking members 82 preferably restrict four degrees of movement of the assembly 10 when stacked on another assembly.

Many modifications will be apparent to those skilled in the art without departing from the scope of the present invention Throughout this specification, unless the context requires otherwise, the word "comprise", and variations such as "comprises" and "comprising", will be understood to imply the inclusion of a stated integer or step or group of integers or steps but not the exclusion of any other integer or step or group of integers or steps.

LIST OF PARTS

10 Assembly
12 Cable
14 Spool
16*a*, 16*b* End member
18*a*, 18*b*, 18*c*, 18*d* Cross-member
20 Axle
22 End section
24 Keyed slot
26 Drum
28*a*, 28*b* Part of drum
30*a*, 30*b* Flange
32 End of drum
34*a*. 34*b* Male and female clip
36*a*, 36*b* Side of part of drum
38 Inner peripheral ledge
40 Outer peripheral ledge
42*a*, 42*b* Locking section
43 Projection
44*a*, 44*b* key
46*a*, 46*b* Slot
48 Indicia
50 Profiled bearing surface
52 Outer peripheral edge section
54*a* Peak
54*b* Trough
56 Aperture
58 Aperture
60 Receiving section
62 Locking section
64 Key
66*a*, 66*b* Flange
68 Locking surface
70*a*, 70*b* Locking member
72 Open end of cross-member
74*a*, 74*b* Tie off section
76 Aperture
78 Retainer
80*a*, 80*b*, 80*c*, 80*d* Side of member

82 Locking member
84*a*, 84*b* Inner and outer section of side of member
86 Receiving section
88 Angled articular surface

The invention claimed is:

1. A spool assembly for dispensing cable comprising:

(a) a spool for receiving a length of cable, including:

(i) a drum comprising first and second parts; and (ii) two flanges couplable to respective opposed end sections of said drum, the flanges having fluted outer peripheral edge sections that define alternating peaks and troughs, the peaks defining a first diameter of the spool and the troughs defining a second diameter of the spool, wherein said end sections of the drum mate with locking sections of the flanges when the parts of the drum are coupled together;

(b) an assembly including first and second end members separated by one or more cross-members and an axle extending at least partially between the end members that rotatably couples the spool to the assembly, each of the first and second end members having an inner side facing the spool and an outer side facing away from the spool, the first end member including a tie off section that defines an aperture extending between the outer and inner sides and sized to receive the cable, the tie off section also including a retainer disposed at the outer side of the first end member at the aperture, the aperture being aligned between the first and second diameters of the spool so that the cable would settle into one of the troughs of one of the fluted outer peripheral edge sections if routed from the spool, through the aperture, to the retainer, thereby inhibiting rotation of the spool with respect to the first and second members.

2. The spool assembly of claim 1, wherein the first and second parts of the drum are concavely shaped and releasably couple together.

3. The spool claimed in claim 1, wherein opposite end sections of the drum are open and include inner peripheral ledges shaped to fit over corresponding outer peripheral ledges of the locking sections of the flanges.

4. The spool claimed in claim 3, wherein the outer peripheral ledges of the locking sections are castellated with projections.

5. The spool claimed in claim 3, wherein the locking sections include locking keys that extend into corresponding slots of the open end sections of the drum to inhibit rotation of the drum with respect to the flanges.

6. The spool claimed in claim 1, wherein the drum includes a slot shaped to receive an end section of the length of cable to enable spooling to start.

7. The spool claimed in claim 1, wherein one or both of the flanges include an outer slot shaped for engagement with a drive dog.

8. The spool claimed in claim 1, wherein the first and second parts of the drum are coupled together with a fastener.

9. The spool claimed in claim 8, wherein the fastener includes male and female interlocking clips located on respective sections of the first and second parts.

10. The spool claimed in claim 1, wherein end sections of the cross-members are releasably coupled to respective keyed slots of the end members.

11. The spool claimed in claim 10, wherein the keyed slots each include:

(i) a receiving section for receiving the end section of a respective one of said cross-members;

(ii) a locking section spaced from the receiving section, the locking section being shaped to receive said end section from the receiving section and to inhibit movement of the respective cross-member in a lengthwise axial direction of the cross-member; and (iii) a key extending over the receiving section for inhibiting movement of the respective cross-member from the locking section towards the receiving section.

12. The spool claimed in claim 11, wherein the end sections of the cross-members resiliently deflect keys of the keyed slots when seated in the receiving sections.

13. The assembly claimed in claim 12, wherein distal end sections of the keys include pairs of locking members, each pair of said pairs being shaped to receive an open end section of a respective one of said end sections of the cross-members therebetween.

14. The assembly claimed in claim 13, wherein the pairs of locking members resiliently separate to accommodate said open end section.

15. The assembly claimed in claim 13, wherein the pairs of locking members of the keys inhibit movement of the cross-members towards corresponding receiving sections of the keyed slots.

16. The assembly claimed in claim 1, wherein the first and second members are generally planar surfaces defined by four sides.

17. The assembly claimed in claim 16, including a common series of raised locking members staggered alternatively between inner and outer sections of each side of the first and second members.

18. The assembly claimed in claim 17, including a common series of locking member receiving sections staggered alternatively between outer and inner sections of each side of the first and second members.

19. The assembly claimed in claim 17, wherein the locking members inhibit movement of the assembly in four directions.

20. The assembly claimed in claim 17, wherein the locking members include angled articular ends of mating with angled articular ends of locking members of another corresponding assembly.

* * * * *